US008186547B2

(12) United States Patent
Morawietz

(10) Patent No.: US 8,186,547 B2
(45) Date of Patent: May 29, 2012

(54) ADJUSTABLE WIDTH HANGER

(76) Inventor: Richard P Morawietz, Richmond Hill (CA)

( * ) Notice: Subject to any disclaimer, the term of this patent is extended or adjusted under 35 U.S.C. 154(b) by 240 days.

(21) Appl. No.: 12/659,870

(22) Filed: Mar. 24, 2010

(65) Prior Publication Data

US 2011/0233240 A1 Sep. 29, 2011

(51) Int. Cl.
*A41D 27/22* (2006.01)

(52) U.S. Cl. ..... 223/94

(58) Field of Classification Search ..... 223/85, 223/89, 90, 94, 98
See application file for complete search history.

(56) References Cited

U.S. PATENT DOCUMENTS

| | | | | |
|---|---|---|---|---|
| 2,446,312 | A * | 8/1948 | Usina | 223/89 |
| 2,814,426 | A * | 11/1957 | Miller | 223/94 |
| 2,900,117 | A * | 8/1959 | Veltry | 223/94 |
| 4,717,053 | A * | 1/1988 | Wang | 223/94 |
| 4,895,283 | A | 1/1990 | Evangelist et al. | |
| 5,082,152 | A | 1/1992 | Chen | |
| 5,085,358 | A | 2/1992 | Lam | |
| 5,145,098 | A * | 9/1992 | Tung | 223/94 |
| 5,476,199 | A | 12/1995 | Halverson et al. | |
| 5,718,358 | A * | 2/1998 | Long et al. | 223/94 |
| 5,941,429 | A * | 8/1999 | Koons | 223/94 |
| 6,062,445 | A | 5/2000 | Nakamoto | |
| 6,068,166 | A | 5/2000 | Kilian et al. | |
| 6,076,716 | A * | 6/2000 | Reyes | 223/94 |
| 6,164,504 | A | 12/2000 | Richard | |
| 6,637,630 | B1 | 10/2003 | Rivenburgh | |
| 6,688,503 | B2 | 2/2004 | Viazanko et al. | |
| 6,811,064 | B2 | 11/2004 | Salem | |
| 7,077,300 | B1 | 7/2006 | Di Pietro | |
| 7,097,081 | B2 | 8/2006 | Frassinelli | |
| 7,328,822 | B2 | 2/2008 | Stokes | |

FOREIGN PATENT DOCUMENTS

| | | |
|---|---|---|
| CA | 127442 | 3/2009 |

* cited by examiner

*Primary Examiner* — Nathan Durham

(57) ABSTRACT

An adjustable width hanger having a main body defining a central neck, and two shoulders of a generally hollow three sided inverted channel shape of thermoplastic material, a plurality of locking seats formed in each of the shoulders, respective extension arms of hollow inverted channel shape formed of thermoplastic material, joint portions formed on the arms dimensioned to be received in the shoulders, locking tabs on the joint portions adapted to interlock with the locking seats in the shoulders, flexible hinges joining said locking tabs to the joint portions, and finger abutments on the locking tabs whereby they may be engaged by a finger and swung between locked and unlocked positions.

7 Claims, 5 Drawing Sheets

ADJUSTABLE WIDTH HANGER

FIELD OF THE INVENTION

The invention relates to clothes hangars, and in particular to a clothes hangar which is adjustable in width, to accommodate clothes of different types, and different sizes.

BACKGROUND OF THE INVENTION.

Clothes hangers usually are supplied in varying widths. Any one width will be suitable only for a relatively narrow range of sizes. Hangers are usually thus sold in varying widths to suit various needs. This is wasteful and may not suit the needs of families. Various proposals have been made for a more universal type of clothes hanger, which can be adjusted to various widths, to suit various needs.

Most of these proposals have been somewhat complex and expensive to make. Operation of such proposals has been complex, and inconvenient.

Clearly, needs for clothes hangers will change with age, and from one sex to another, and even with changes in fashion.

The provision of one hanger, which is adaptable over such a wide range of utility will solve household problems, and will avoid the need for buying several different types of hangers in one household.

Preferably such a universal hanger with adjustable width will be made as simple as possible, both for economy in manufacture, and for simplicity in use.

Thermoplastics are one highly suitable material for the purpose.

However, forming such a universal hanger, using injection moulding methods, requires much attention to the design both of its utility as a hanger, and also as to its simplicity of operation, to change its width.

BRIEF SUMMARY OF THE INVENTION

With a view to meeting these various different requirements the invention provides an adjustable width hanger having a main body defining a central neck, and two shoulders of a generally hollow three sided inverted channel shape of thermoplastic material, a plurality of locking seats formed in each of said shoulders, respective extension arms of hollow inverted channel shape formed of thermoplastic material, joint portions formed on said arms dimensioned to be received in said shoulders, locking tabs on said joint portions adapted to interlock with said locking seats in said shoulders, flexible hinges joining said locking tabs to said joint portions, and finger abutments on said locking tabs whereby they may be engaged by a finger and swung between locked and unlocked positions.

Preferably the hanger will include locking catches formed on said locking seats, for engagement by said locking tabs.

Preferably the hanger will include hooks on said locking tabs for engaging said locking catches.

Preferably the hanger will include an integral self hinge formed of thermoplastic material, extending along the axis of said joint portions and connecting with said locking tabs.

Preferably the hanger will include a locking tab defining a body having a locking hook at one end and a finger button at the other end, and wherein said self hinge connects to said body between said hook and said finger button.

Preferably the hanger will include a hook defining a ramp surface for contacting said catch on said seat, and causing swinging of said body on said self hinge.

Preferably the hanger will include extension arms defining a first predetermined width and depth and wherein said joint portions define a second predetermined width and depth, less than said first width and depth.

Preferably the hanger will include shoulders defining side support walls extending integrally therefrom and define inner ends connected integrally to said shoulders, and define outer ends remote therefrom, and including bearing bars formed transversely across said side support walls at said outer ends of said side support walls.

Preferably the hanger will include notches formed in said extension arms, said bearing bars fitting within respective said notches.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
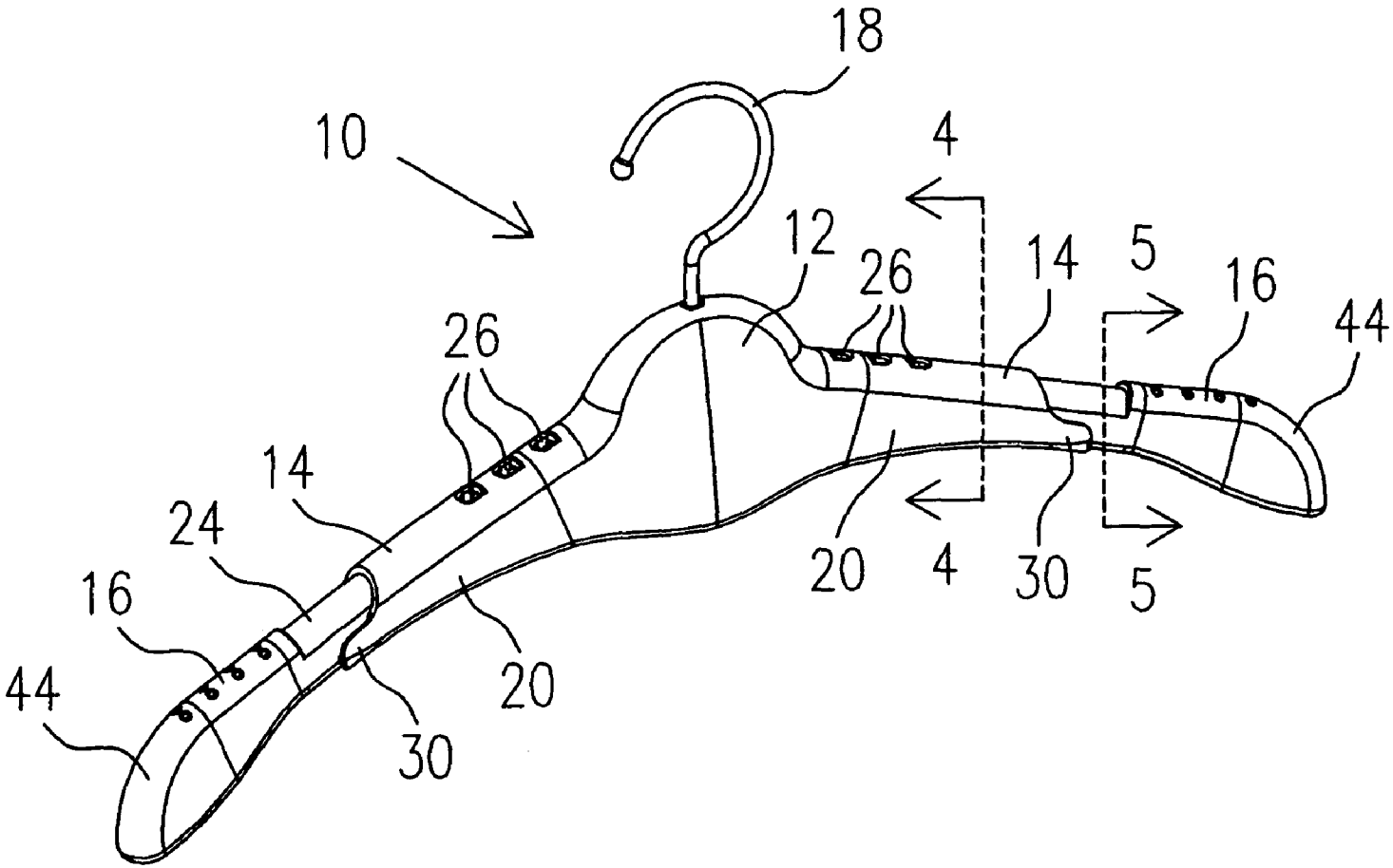
FIG. 1 is an isometric of an adjustable width hanger illustrating the invention.
Figure 2:
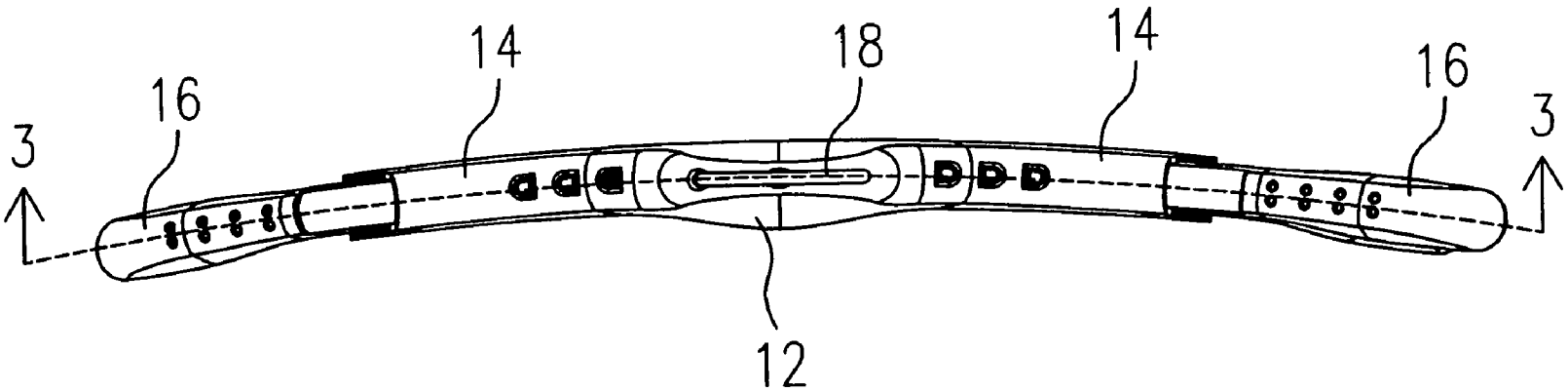
FIG. 2 is a lower plan view of the hanger of FIG. 1.
Figure 3:
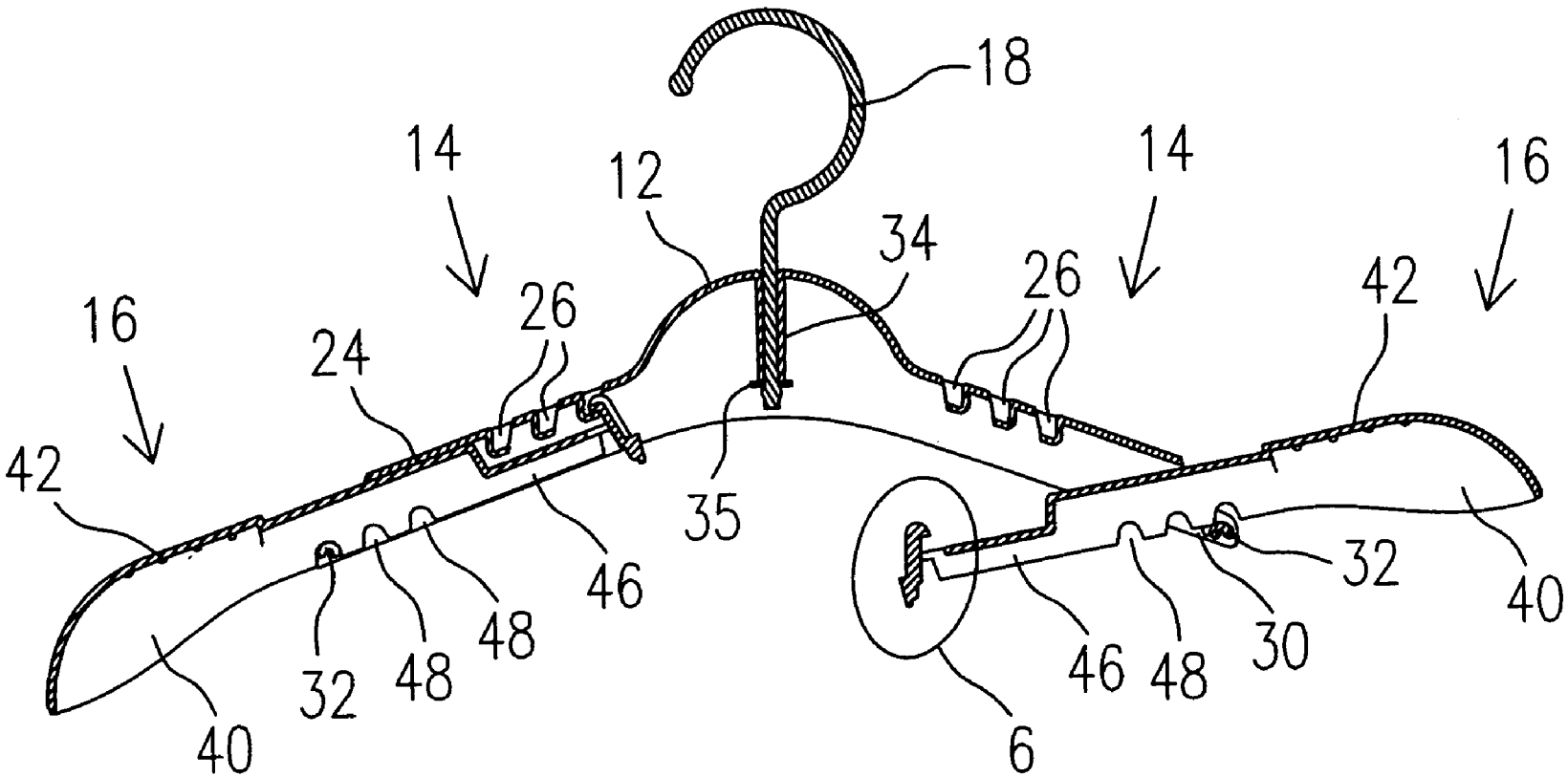
FIG. 3 is a section along line 3-3 of FIG. 2, shown partially open.
Figure 5:
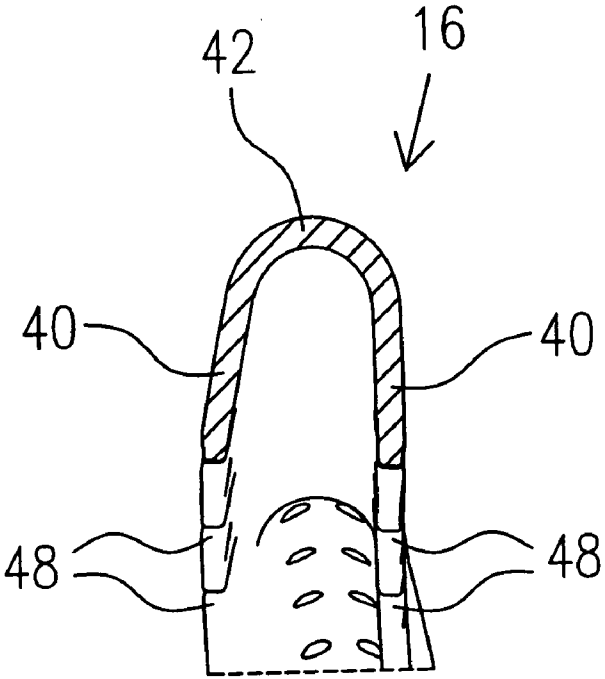
FIG. 5 is a section along the line 5-5 Of FIG. 1.

Referring to FIG. 1 it will be seen that the invention is illustrated there, by way of example only, in the form of an adjustable width hanger (10).

Hanger (10) comprises three main portions, a central neck portion (12), and two shoulders (14), formed integrally on either side of the neck portion (12).

It will be apparent that the neck portion (12) is at its greatest depth at about its mid point, Shoulders (14) slope down on either side towards respective extension arm portions (16).

A typical hook (18) extends up from the centre of neck portion (12).

Figure 4:
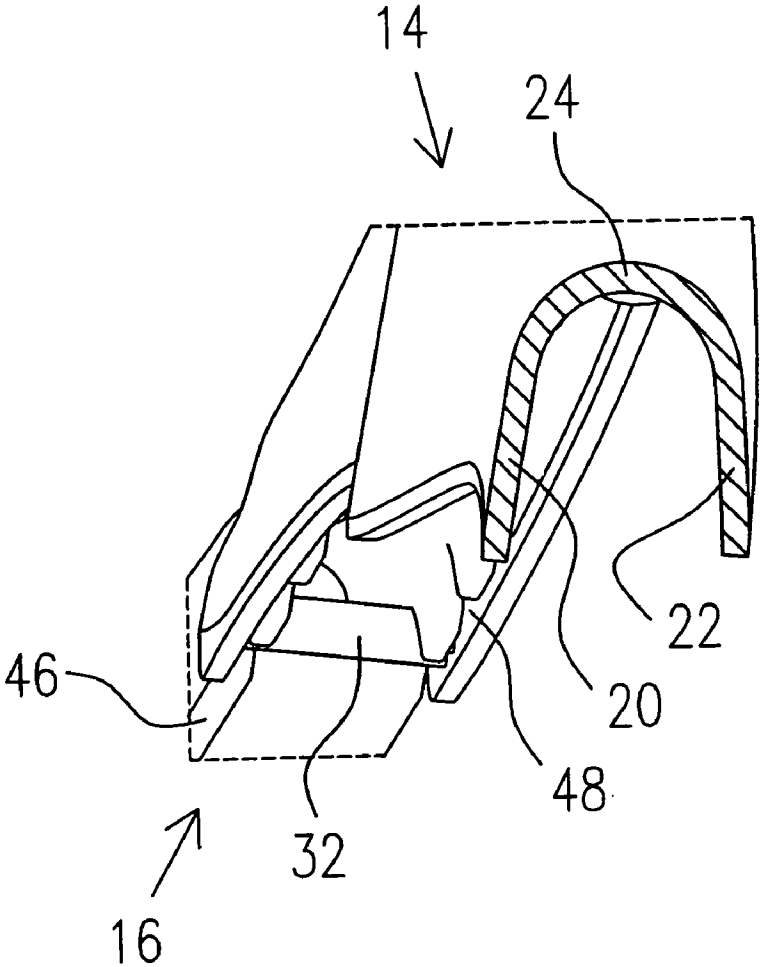
FIG. 4 is a section along 4-4 of FIG. 1.

As seen from FIG. 4, the neck portion (12) and shoulders are in the form of a hollow inverted channel having front and back side walls (20) and (22) and an arcuate top wall (24).

This provides great strength, notwithstanding that it will usually be made of injection moulded thermoplastic material.

Locking seats (26) are formed as openings, spaced apart along the top walls (24) of shoulders (14).

Each of the shoulders (14) has a pair of side support walls (30) extending from the side walls (20,22). Note that the top wall is not extended at this region, so that the two side support walls define both upper and lower openings, for reasons described below.

A bearing bar (32) extends between each pair of side support walls, at the lowest points of the outer ends, for reasons described below.

A tubular column (34) extends down from the apex of neck (12).

Hook (18) is received in the column (34), and is retained at its lower end by a washer (34) or other retention device.

In order to provide full support for articles of clothing of varying widths and sizes, and designs, a pair of extension arms (16) are provided. Each of arms (16) is of generally hollow inverted three sided channel shape in section, having side walls (40) and an arcuate top wall (42), (FIG. 4).

At their outer ends the extension arms (16) have enlarged, convex dome shaped formations (44), for providing better support for certain types of clothing.

At their inner ends the extension arms have reduced sliding channels (46). These are three sided channels of reduced width and height, compared to the main portions of extension arms (16).

Notches (48) are formed in opposite side walls of extension arms (16), located at spaced intervals, to receive bars (32).

Figure 7:
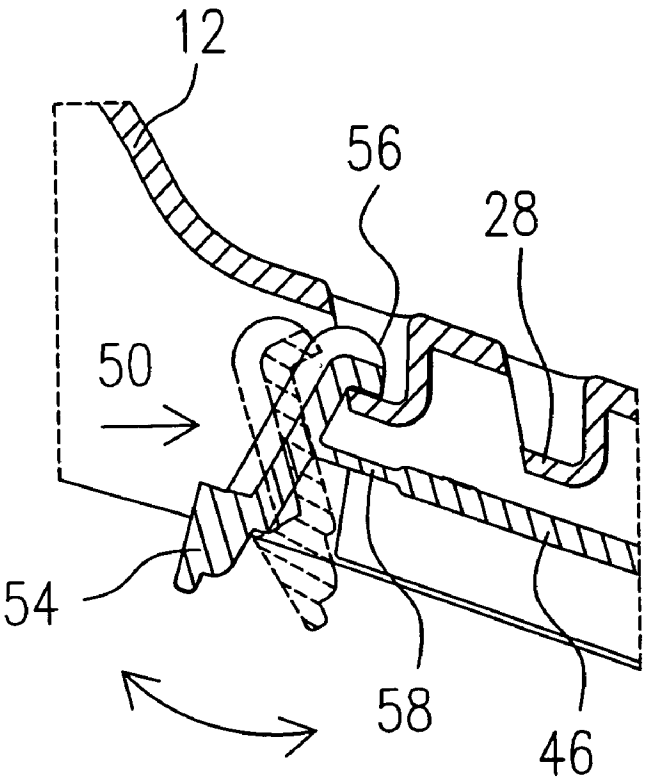
Figure 6:
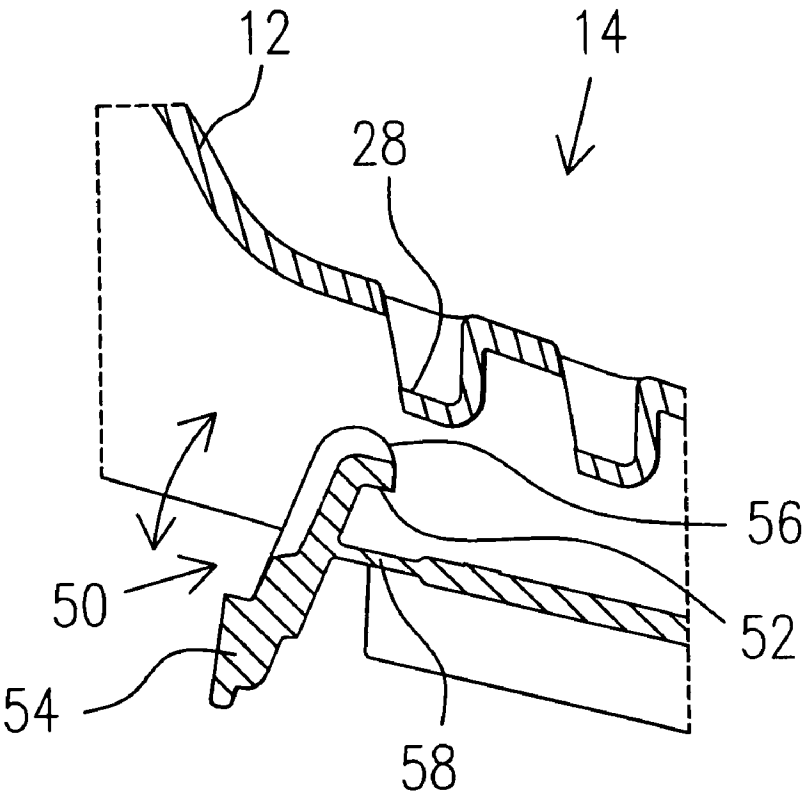
FIG. 6 is an enlarged section of the detail circled at 6 in FIG. 3; and, FIG. 7 corresponds to FIG. 6 showing the parts in another position.

At the inner ends of channels (46) locking tabs (50) are provided (FIGS. 6 and 7). Locking tabs (50) each comprise a main body having a hook (52) at the upper end, and a finger button (54) at the lower end.

Hooks (52) have angled ramp surfaces (56).

Extending integrally, normal to main body between hooks (52) and buttons (54) there is an integral self hinge (58) formed of thermoplastic material. This enables the main body to swing relative to channels (46).

When adjusting the length of the extension arms (16) the locking tabs (50) are first released from respective locking seats (26), by operating their finger buttons (54).

The extension arms (16) are then free to be swung down, around bars (32)

The extension arms (16) can then be slid inwardly, or outwardly, to engage bars (32) in notches (48) in different locations.

The extension arms (16) are then swung up, into alignment with shoulders (14).

This will bring locking tabs (50) into contact with seats (26).

The ramp surfaces (56) will cause tabs (50) to flex on hinges (58) and allow the hooks to slip around and lock on to the catches (28) of seats (26).

Once locked in position, the extension arms (16) form endwise extensions of shoulders (14).

All of the aforesaid components are formed by injection moulding.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An adjustable width hanger, and comprising;

a main body defining a central neck, and two shoulders of a generally hollow three sided inverted channel shape of thermoplastic material;

a plurality of locking seats formed in each of said shoulders;

respective extension arms of hollow inverted channel shape formed of thermoplastic material;

joint portions formed on said extension arms dimensioned to be received in said shoulders;

locking tabs on said joint portions adapted to interlock with said locking seats in said shoulders;

locking catches formed on said locking seats, for engagement by said locking tabs;

hooks on said locking tabs for engaging said locking catches;

flexible hinges joining said locking tabs to said joint portions; and, finger abutments on said locking tabs whereby they may be engaged by a finger and swung between locked and unlocked positions.

2. An adjustable width hanger as claimed in claim 1, and including an integral self hinge formed of thermoplastic material, extending along the axis of said joint portions and connecting with said locking tabs.

3. An adjustable width hanger as claimed in claim 2 wherein said locking tab defined a body having a locking hook at one end and a finger button at the other end, and wherein said self hinge connects to said body between said hook and said finger button.

4. An adjustable width hanger as claimed in claim 3 wherein said hook defines a ramp surface for contacting said seat, and causing swinging of said body on said self hinge.

5. An adjustable width hanger as claimed in claim 4 wherein said extension arms define a first predetermined width and depth and wherein said joint portions define a second predetermined width and depth, less than said first width and depth.

6. An adjustable width hanger as claimed in claim 5 wherein said shoulders define side support walls extending integrally therefrom and define inner ends connected integrally to said shoulders, and define outer ends remote therefrom, and including bearing bars formed transversely across said side support walls at said outer ends of said side support walls.

7. An adjustable width hanger as claimed in claim 6 including notches formed in said extension arms, said bearing bars fitting within respective said notches.

* * * * *